US009260664B2

(12) United States Patent
Badura

(10) Patent No.: US 9,260,664 B2
(45) Date of Patent: Feb. 16, 2016

(54) METHOD FOR COLLECTING RESIDUAL COKE FROM NON-RECOVERY AND HEAT-RECOVERY COKE OVENS

(75) Inventor: Sven Badura, Bottrop (DE)

(73) Assignee: ThyssenKrupp Uhde GmbH, Dortmund (DE)

( * ) Notice: Subject to any disclaimer, the term of this patent is extended or adjusted under 35 U.S.C. 154(b) by 731 days.

(21) Appl. No.: 13/583,558

(22) PCT Filed: Feb. 10, 2011

(86) PCT No.: PCT/EP2011/000634

§ 371 (c)(1),
(2), (4) Date: Sep. 7, 2012

(87) PCT Pub. No.: WO2011/110269

PCT Pub. Date: Sep. 15, 2011

(65) Prior Publication Data

US 2013/0062187 A1 Mar. 14, 2013

(30) Foreign Application Priority Data

Mar. 10, 2010 (DE) ..... 10 2010 010 988

(51) Int. Cl.

| | |
|---|---|
| ***C10B 33/00*** | (2006.01) |
| ***C10B 33/10*** | (2006.01) |
| ***C10B 33/14*** | (2006.01) |
| ***C10B 45/00*** | (2006.01) |

(52) U.S. Cl.

CPC ..... *C10B 33/003* (2013.01); *C10B 33/10* (2013.01); *C10B 33/14* (2013.01); *C10B 45/005* (2013.01)

(58) Field of Classification Search

CPC ..... C10B 33/00; C10B 33/003; C10B 33/10; C10B 33/14; C10B 45/00; C10B 45/005

USPC ..... 201/40, 41; 202/262, 270

See application file for complete search history.

(56) References Cited

U.S. PATENT DOCUMENTS 2,224,392 A * 12/1940 Imes ..... 414/163
2,706,564 A * 4/1955 Peters ..... 414/684.3

(Continued)

FOREIGN PATENT DOCUMENTS

| | | |
|---|---|---|
| DE | 102007045426 | 4/2009 |
| JP | 57078483 | 5/1982 |
| WO | 2007022816 | 3/2007 |

OTHER PUBLICATIONS

International Search Report for PCT/EP2011/000634, English translation attached to original, Both completed by the European Patent Office on May 18, 2011, All together 5 Pages.

*Primary Examiner* — Renee E Robinson
*Assistant Examiner* — Jonathan Miller
(74) *Attorney, Agent, or Firm* — Brooks Kushman P.C.

(57) ABSTRACT

A method is disclosed for collecting so-called residual coke from a coke oven chamber while the door of the coke oven chamber is being opened. A collecting device is moved up against a guide plate arranged under the door of the coke oven chamber before the door of the coke oven chamber is opened, and the coke that falls out of the coke oven chamber falls across the guide plate into a collecting device. The collecting device is moved to a horizontal position after the coke has been collected so that the upper edge of the collecting device is at the height of the bottom of the coke oven chamber. The push-out device of the coke oven operating machine moves over the collecting device between the suspensions so that the coke is pushed out of the collecting device back into the coke oven chamber.

9 Claims, 4 Drawing Sheets

(56) References Cited

U.S. PATENT DOCUMENTS 4,166,007 A * 8/1979 Becker, Jr. ..... 202/262
4,276,121 A * 6/1981 Rogers ..... 202/227
4,276,123 A * 6/1981 Emery ..... 202/241
4,388,153 A * 6/1983 Blair et al. ..... 202/248
6,290,494 B1 * 9/2001 Barkdoll ..... 432/121

* cited by examiner

METHOD FOR COLLECTING RESIDUAL COKE FROM NON-RECOVERY AND HEAT-RECOVERY COKE OVENS

CROSS-REFERENCE TO RELATED APPLICATION

This application is the U.S. national phase of PCT Appln. No. PCT/EP2011/000634 filed on Feb. 10, 2011, which claims priority to German Patent Application No. 10 2010 010988.6 filed on Mar. 10, 2010, the disclosures of which are incorporated in their entirety by reference herein.

BACKGROUND OF THE INVENTION

1. Filed of the Invention

The invention relates to a method for capture of spillage coke from non-recovery and heat-recovery coke ovens, said spillage coke falling from a coke oven chamber as coke oven chamber doors are opened. By way of this method, any coke falling out can be transported back into a coke oven chamber without the need for quenching or transporting coke into a collecting container.

2. Description of the Related Art

Coke is usually produced in cycles. To this effect, a coke oven chamber is charged with coal envisaged for coal carbonization, coke oven chamber doors are closed, and the coke-making cycle is initiated. Upon coal carbonization, coke oven chamber doors are opened and coke is pushed through the oven out of the coke oven chamber. On opening the doors, some coke frequently falls out from the coke oven chamber which causes emissions as well as undesired losses of coke. Prior art technology therefore proposes devices by means of which coke is captured by capturing devices or coke shovels and disposed of or quenched further rearwards.

DE 102007045426 A1 relates to a coke oven operating machine comprised of a coke pusher machine or coke transfer machine equipped with a coke oven operating facility to capture and remove spillage coke as well as with a suction device to suck-off emissions in the area of the coke shovel, said suction element being connected to the coke oven service machine separately from the coke shovel, and said coke shovel being movably arranged relatively to the suction element to move from its home position into the capturing position. By way of this method, even those emissions in the area of the coke shovel are captured that are caused by quenching the coke in the coke shovel or that are not captured by the suction facilities usually provided on a coke oven pusher machine or coke transfer machine. Coke is at least partially quenched in the coke shovel and disposed of further rearwards into a capturing device by making it possible to move the coke shovel from the capturing position into a discharging position.

WO 2007/022816 A1 describes a device as a coke oven operating machine comprised of a coke pusher machine and/or a coke transfer machine which serves to remove spillage coke in or from the area of a coke oven bench gallery, utilizing a shoveling facility comprised of at least one coke shovel arranged in a capturing position beneath an oven door of a coke oven chamber near the bottom floor of the bench gallery, at least one suction device being provided at and/or in the coke shovel to suck-off emissions released in the area of the coke shovel. To empty the coke shovel, it is raised in the area of the bench gallery near the bottom level and swung into a position subsequently required for a further rearward discharge.

These processes utilize the coke shovel to collect spillage coke, the coke shovel being discharged into a ramp arranged rearwards. Quenching of coke is performed at least partly in the coke shovel. A reuse of captured coke or bringing it into the pushed coke cake is not envisaged. However, it would be much more favorable to press the spillage coke on coke pushing back into the coke oven chamber so that it is further utilized together with the remaining coke cake. It would obviate the need for additional collecting and transporting facilities for spillage coke which, for example, must be transported from the collecting device into the coke quenching car.

SUMMARY OF THE INVENTION

Now, therefore, it is the object of the present invention to provide a method by means of which the coke falling out from a coke oven chamber is captured and transported back into the coke oven chamber.

The invention solves this task by providing a method by means of which, as proposed in prior art technology, the spillage coke falling out when a coke oven chamber door is opened is captured and slid back by the coke pusher machine from the capturing facility into the coke oven chamber. According to this method, the capturing device is moved to the bottom edge of a guide plate which in a typical configuration is located in stationary arrangement beneath the coke oven chamber door so that the capturing device of the coke pusher machine can take-up the spillage coke by the aid of the thin guide plate provided at the coke oven. By subsequently raising the capturing device, the coke pusher machine can slide the spillage coke directly back into the coke oven chamber.

DETAILED DESCRIPTION OF THE PREFERRED EMBODIMENTS

Figure 1:
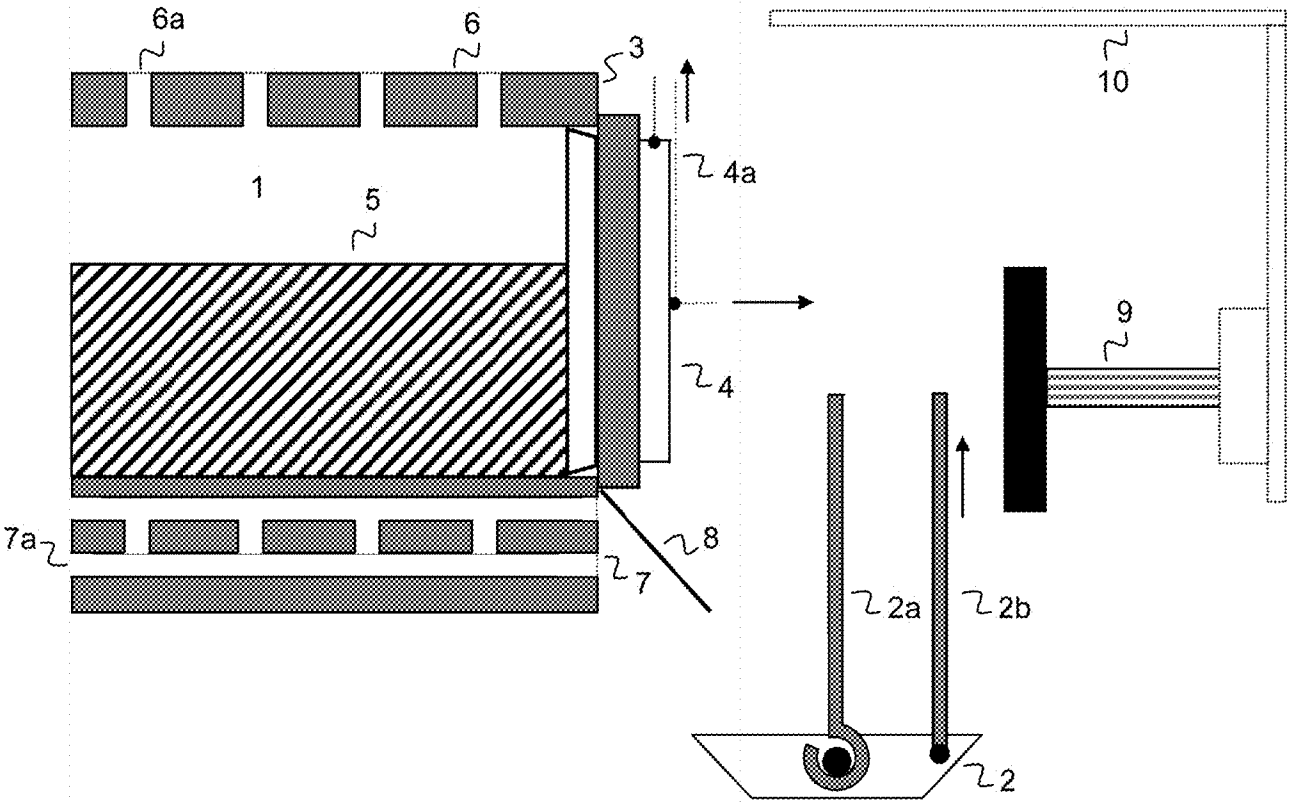
FIG. 1 illustrates a coke oven equipped with a guide plate below the oven door and a spilled coke container, with the oven door closed.

Claim is laid in particular to a method for capture of hot coke falling out from a coke oven chamber while opening the coke oven chamber door, wherein

- a capturing device is approached to a guide plate located beneath the coke oven chamber door or which is approached to it, and
- the coke oven chamber door is opened after the capturing device has been moved out, and wherein the coke falling out from a coke oven chamber falls via the guide plate into the capturing device, and which is characterized in that

- the capturing device is moved into a horizontal position after the coke has been captured so that the upper edge of the capturing device lies at least on a level with the bottom floor of the coke oven chamber, and
- the coke pusher facility of the coke oven service machine travels over the capturing device between the suspensions so that the coke is slid back from the capturing device into the coke oven chamber.

Preferably the capturing device is a coke shovel. The suspension of the capturing device is so configured that the coke pushing facility dimension in horizontal direction is smaller than the suspension of the capturing device so that the coke pushing facility can pass through the capturing device. In principle, this method is suitable for all coke ovens, but in particular for coke ovens of the "Heat Recovery" or "Non-Recovery" type. With advantage, the coke oven chambers are so arranged that they form a coke oven bank or a coke oven battery in which several coke oven chambers are arranged one behind the other. It enables the coke oven operating machine, which the capturing device and the coke pusher machine belong to, to travel alongside the front of the coke oven chambers.

In an important embodiment, the guide plate is arranged beneath the coke oven chamber door. In a typical embodiment, it is provided in stationary arrangement at each coke oven. It is also conceivable to approach the guide plate with the capturing device to the coke oven chamber door. In this case, too, it is required to provide an appropriate mechanism at the capturing device. Finally it is also conceivable to provide a special mechanism to make it possible to approach the guide plate to each coke oven chamber.

Depending on the depth of the capturing device, it may also be expedient to retract the rear wall of the capturing device so that the coke pusher facility of the coke oven operating machine travels between the suspensions into the capturing device, the coke being pressed from the capturing device back into the coke oven chamber. Accordingly, the coke pushing facility can be movable in vertical direction so that a complete discharge of the capturing device into the coke oven chamber is feasible even if the capturing device provided with a closing slope remains in horizontal position when coke is pushed.

The suspension of the capturing device and the moving mechanism may be of an arbitrary configuration. In a preferred embodiment, the suspension device is suspended by a mechanism to a carrying device located above. In a further embodiment, it is also feasible to provide the carrying mechanism or the moving mechanism or both either in an arrangement coming from below or from the side.

By means of the inventive method, so-called spillage coke falling out from a coke oven chamber when opening a coke oven chamber doors can be captured and slid back into the coke oven chamber without quenching the spillage coke.

The inventive method is outlined by way of four drawings which characterize the various steps of the method—opening the coke oven chamber, falling-out of spillage coke, sliding the spillage coke back into the coke oven chamber, and pushing the coke out of the oven.

FIG. 1 shows the opening of coke oven chamber (1) and extending the capturing device (2) at the coke oven chamber front (3). The coke oven chamber door (4) is pulled by an opening facility (4*a*) out of the coke oven chamber (1). To be seen in the coke oven chamber (1) is the coke cake (5). In the embodiment illustrated here, the coke oven chamber (1) is comprised of a coke oven chamber decking (6), a substructure (7), and a coke oven chamber door (4). The substructure (7) may also be equipped with heating chambers (7*a*) or secondary air ducts. The coke oven chamber decking (6) and the coke oven chamber door (4) may be equipped with ventilating facilities (6*a*), if required. The capturing device (2) is approached to the guide plate (8) which is arranged at the coke oven chamber front beneath the coke oven sole. To be seen in front of the coke oven chamber door (4) is the coke pusher machine (9) as part of the coke oven service machine (10). It is constructively connected to the capturing device (2). The capturing device (2) can be swivelled via a suspension (2*a*) through a vertical traction device (2*b*).

Figure 2:
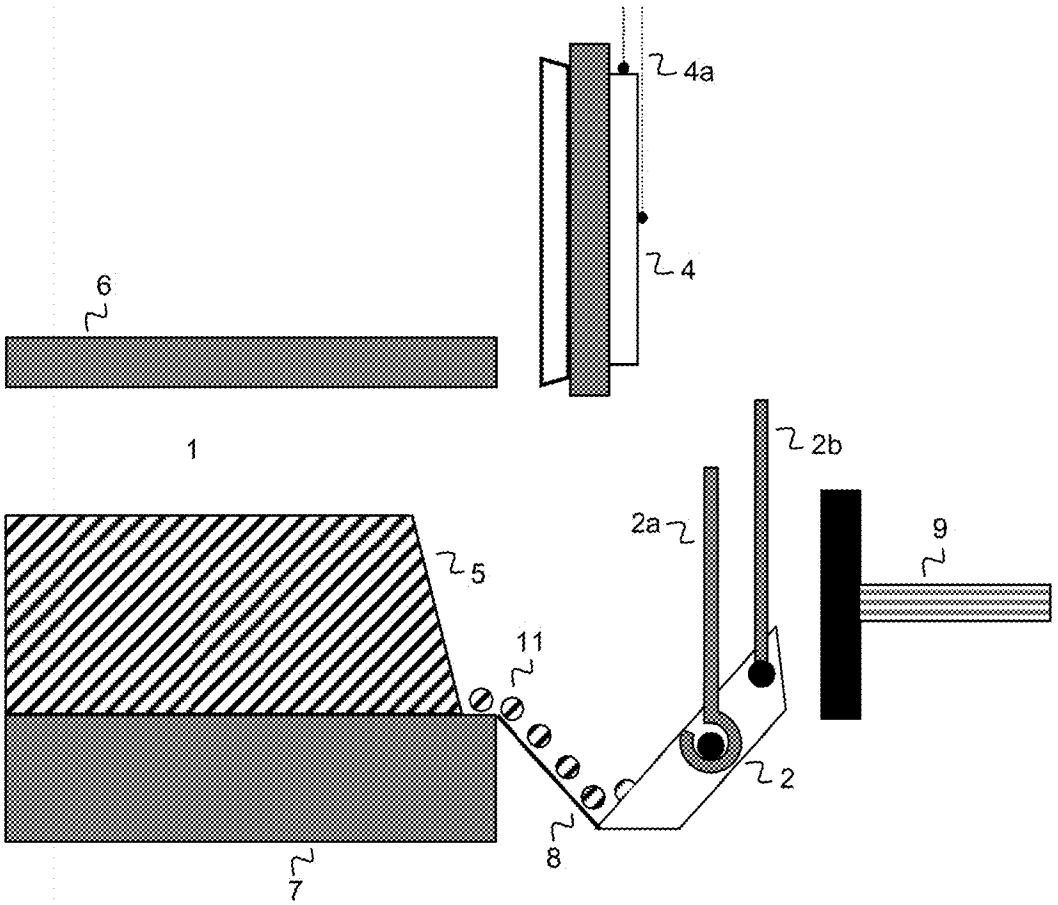
FIG. 2 illustrates spillage of coke into the spilled coke container upon opening of the oven door.

FIG. 2 shows the falling-out of spillage coke (11) from an opened coke oven chamber (1). It is guided via the guide plate (8) into the capturing device (2). To this effect, the capturing device (2) is moved into a tilted position. Here, the coke oven chamber door (4) can be seen in opened position. Depending on the expected amount of spillage coke (11) falling out, the capturing device (2) may be provided with a different depth or with a rear wall which can be folded back.

Figure 3:
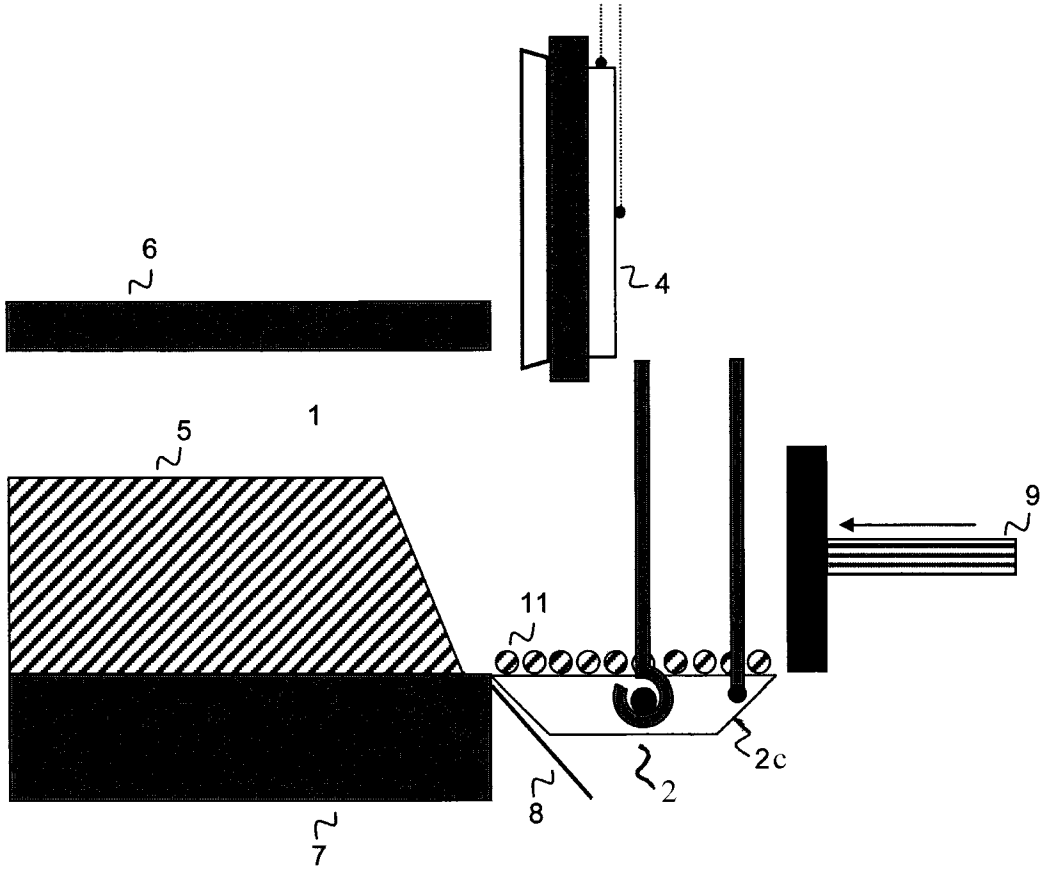
FIG. 3 illustrates repositioning of the spilled coke container to a horizontal position at least at a level with the coke oven chamber bottom floor.

FIG. 3 shows the sliding-back of spillage coke (11) from the capturing device (2) into the coke oven chamber (1). Spillage coke (11) is slid through the suspensions (2*a*) of the capturing device from the capturing device (2) back into the coke oven chamber (1). Depending on the depth of the capturing device (2), its rear wall (2*c*), too, can be folded back and the coke pusher machine (9) can be moved up and down in vertical direction.

Figure 4:
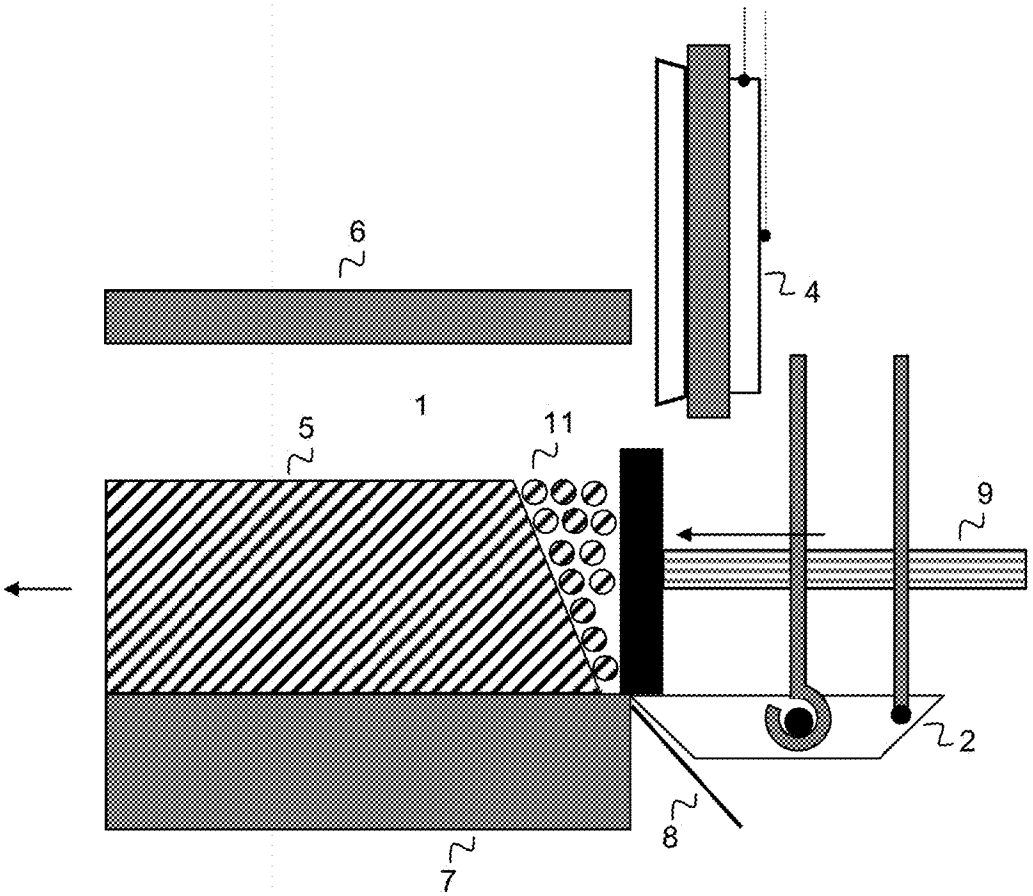
FIG. 4 illustrates sliding the spilled coke into the oven chamber to rejoin the coke cake and pushing the spilled coke and coke cake from the oven.

FIG. 4 shows the pushing of the coke cake (5) out of the oven. After the spillage coke (11) has been slid back, the coke cake (5) is pushed through the coke oven chamber (1) out of the oven.

LIST OF REFERENCE NUMBERS

1 Coke oven chamber
2 Capturing device
2*a* Suspension of the capturing device
2*b* Vertical traction device
2*c* Rear wall of spilled coke container
3 Coke oven chamber front
4 Coke oven chamber door
4*a* Opening facility of the coke oven chamber door
5 Coke cake
6 Coke oven chamber decking
6*a* Ventilating facility in the coke oven chamber decking
7 Substructure
7*a* Heating chamber
8 Guide plate
9 Coke pusher machine
10 Coke Oven Operating Machine
11 Spillage coke

The invention claimed is:

1. A method for the capture of spilled coke from a coke cake spilling from a coke oven upon opening a first coke oven door of said coke oven and for sliding said spilled coke back into the coke oven to rejoin the coke cake, the coke oven associated with a coke pusher for pushing a hot coke cake through a second coke oven door located on a side of said coke oven remote from said coke pusher, the method comprising:

providing a guide plate positioned below said first coke oven door;

providing a spilled coke container having an upper edge, for receiving spilled coke, the spilled coke container mounted on pivots between suspensions on first and second sides of the spilled coke container;

altering the relative positions of the guide plate and the spilled coke container such that coke spilling from the coke oven upon opening the first coke oven door slides down the guide plate and into the spilled coke container;

raising the spilled coke container to a position where said upper edge is at least on a level with a bottom floor of the coke oven, and pivoting the spilled coke container via the suspensions and a vertical traction device, traversing the coke pusher along the spilled coke container through the suspensions and sliding the spilled coke in the spilled coke container back into the oven; and pushing the coke cake and spilled coke slid into the coke oven by the coke pusher through the coke oven and out said second coke oven door.

2. The method of claim 1, wherein the coke container has a bottom, sidewalls extending upwards from the bottom, and a rear wall between the sidewalls.

3. The method of claim 1, wherein the guide plate is attached to a structure containing the coke oven.

4. The method of claim 3, wherein the coke oven is one of a plurality of coke ovens in a coke oven bank, and a guide plate is provided for each coke oven.

5. The method of claim 1, wherein the guide plate is attached to the spilled coke container, and the guide plate is moved to a position below the first coke oven door prior to opening the first coke oven door.

6. The method of claim 5, wherein the coke oven is one of a plurality of coke ovens in a coke oven bank, and a single guide plate is used for all the ovens in the coke oven bank.

7. The method of claim 2, wherein the rear wall of the spilled coke container is a moveable rear wall.

8. The method of claim 7, wherein the moveable rear wall of the spilled coke container is retracted prior to the coke pusher traversing the spilled coke container.

9. The method of claim 1, wherein the spilled coke container comprises a coal shovel.

* * * * *